US006535079B1

(12) United States Patent
Hiroshima et al.

(10) Patent No.: US 6,535,079 B1
(45) Date of Patent: Mar. 18, 2003

(54) DIELECTRIC FILTER, DIELECTRIC DUPLEXER, AND COMMUNICATION APPARATUS

(75) Inventors: Motoharu Hiroshima, Nomi-gun (JP); Shohachi Nishijima, Komatsu (JP); Hideyuki Kato, Ishikawa-gun (JP)

(73) Assignee: Murata Manufacturing Co., Ltd. (JP)

( * ) Notice: Subject to any disclaimer, the term of this patent is extended or adjusted under 35 U.S.C. 154(b) by 0 days.

(21) Appl. No.: 09/707,683

(22) Filed: Nov. 6, 2000

(30) Foreign Application Priority Data

Nov. 5, 1999 (JP) ..... 11-314657

(51) Int. Cl.[7] ..... H01P 1/20
(52) U.S. Cl. ..... 333/134; 333/206; 333/222
(58) Field of Search ..... 333/134, 206, 333/204, 202, 219.1, 222

(56) References Cited

U.S. PATENT DOCUMENTS

| | | | | |
|---|---|---|---|---|
| 2,859,417 A | | 11/1958 | Arditi | |
| 3,735,289 A | | 5/1973 | Bruene | |
| 4,371,853 A | | 2/1983 | Makimoto et al. | |
| 5,489,882 A | * | 2/1996 | Ueno | 333/206 |
| 6,222,431 B1 | * | 4/2001 | Ishizaki et al. | 333/206 |

FOREIGN PATENT DOCUMENTS

| | | |
|---|---|---|
| EP | 0836239 A1 | 4/1998 |
| JP | 7254807 | 10/1995 |

OTHER PUBLICATIONS

Miyake H. et al., "Balanced–Input–Output Configuration of Laminated Planar Filter Suitable for Next–Generation Super–Compact Portable Telephones", 1999 IEEE MTT–S International Microwave Symposium Digest, Jun. 13–19, 1999, vol. 3, pp. 1143–1146, XP000896833.

* cited by examiner

*Primary Examiner*—Robert Pascal
*Assistant Examiner*—Kimberly E. Glenn
(74) *Attorney, Agent, or Firm*—Dickstein, Shapiro, Morin & Oshinsky LLP

(57) ABSTRACT

A dielectric filter, a dielectric duplexer, and a communication apparatus using them allow balanced input and/or output to be implemented without requiring a balun. Using a dielectric block, two λ/2 resonators are individually formed using either inner-conductor-forming openings with inner conductors therein, or stripline-type conductors, both of said conductors having both ends open-circuited, and said conductors being capacitively coupled together. Terminal electrodes coupled to the vicinities of two open-circuited ends of one of the resonators are used as balanced terminals on one side, and terminal electrodes coupled to the vicinities of the two open-circuited ends of the other one of the resonators are used as balanced terminals on the other side.

16 Claims, 5 Drawing Sheets

DIELECTRIC FILTER, DIELECTRIC DUPLEXER, AND COMMUNICATION APPARATUS

BACKGROUND OF THE INVENTION

1. Field of the Invention

The present invention relates to a dielectric filter for use in microwave bands and the like, a dielectric duplexer, and a communication apparatus using them.

2. Description of the Related Art

Conventional filters for use in microwave bands and the like include a dielectric filter that is formed by providing an inner-conductor-forming opening or inner-conductor-forming openings in a dielectric block to form one resonator or a plurality of resonators, and by providing an outer conductor on outer faces of the dielectric block.

In the conventional dielectric filter using the dielectric block, terminal electrodes coupled by electrostatic capacitance to the inner conductors are provided to perform unbalanced-type input and/or output of signals. Therefore, to feed signals to, for example, a balanced-input/output-type amplifier circuit, a balun (balanced-unbalanced converter) is needed to convert unbalanced-type signals to balanced-type signals. However, the dielectric filter of this type gives rise to problems. Insertion loss because of the balun is large. Also, spacing must be secured for arranging the balun on a circuit substrate, and miniaturization cannot therefore be implemented.

To solve the above-described problems, Japanese Unexamined Patent Application Publication No. 7-254807 discloses a dielectric filter capable of performing balanced-type input and/or output of signals. In this balanced-type dielectric filter, however, to electrically connect an inner conductor to terminal electrodes on an outer face of a dielectric block, openings must be formed perpendicular to an inner-conductor-forming opening. It is very difficult to form the openings perpendicular to the inner-conductor-forming opening in the dielectric block. Therefore, manufacturing costs are increased. In addition, since both balancing characteristics and the degree of external coupling are influenced by the positions of the openings that form the aforementioned connecting conductors, high forming accuracy is required to obtain predetermined characteristics. Also, adjustment after forming is difficult.

SUMMARY OF THE INVENTION

The present invention provides a dielectric filter, a dielectric duplexer, and a communication apparatus using them, which allow balanced-type input and/or output of signals to be implemented, and concurrently, allow manufacturing costs to be easily reduced.

According to one aspect of the present invention, a dielectric filter is made by forming a conductor film on a single dielectric material to provide at least two $\lambda/2$ resonators that individually have two ends being open-circuited, that resonate at ½-wavelength at a predetermined frequency, and that are coupled together. Terminals are individually coupled by electrostatic capacitance to vicinities of the two open-circuit ends of each of the $\lambda/2$ resonators and are used for balanced input and/or output of signals.

According to the above aspect of the invention, without a balun being used, direct connection can be made to a balanced-input/output-type amplifier circuit, since balanced terminals are used to perform input and/or output of signals.

Concurrently, either passage or attenuation of a predetermined frequency band can be performed. Therefore, the dielectric filter can be miniaturized, and production costs therefor can be reduced. In this case, since the resonators and the balanced terminals are coupled by the electrostatic capacitance, filter characteristics can easily be adjusted.

Also, according to the above aspect of the invention, each of the two $\lambda/2$ resonators may either be formed using a microstrip line or a strip line, or be formed of a dielectric coaxial resonator made by providing the conductor films in and on a dielectric block. In this case, no balun needs to be formed, and a filter for performing balanced input and/or input of signals can be easily formed on a dielectric substrate.

In addition, each of the two $\lambda/2$ resonators may be formed of a dielectric coaxial resonator made by providing the conductor films in and on a dielectric block. In this case, despite the dielectric filter being formed of the coaxial resonators, mounting of only the dielectric filter on a mounting substrate or the like allows a circuit for performing balanced input and/or output of signals and a circuit having the filter to be concurrently formed. Therefore, the area occupied on the mounting substrate can be reduced, and the mounting efficiency can be improved.

Furthermore, according to another aspect of the present invention, a dielectric duplexer is formed by providing a transmission filter and a reception filter that have the above-described configuration. In this case, the dielectric duplexer can be used as an antenna-sharing unit that performs balanced input and/or output of transmission signals and/or reception signals. In addition, miniaturization can be implemented for amplifier circuits and the like that perform balanced input and/or output as well as a high-frequency circuit section in the vicinity of the antenna.

According to still another aspect of the present invention, a communication apparatus is formed by using one of the above-described dielectric filters and/or the above-described dielectric duplexer. Therefore, a small and light communication apparatus can be constructed.

Other features and advantages of the present invention will become apparent from the following description of embodiments of the invention which refers to the accompanying drawings, in which like references indicate like elements and parts.

DESCRIPTION OF EMBODIMENTS OF THE INVENTION

Figure 1A:
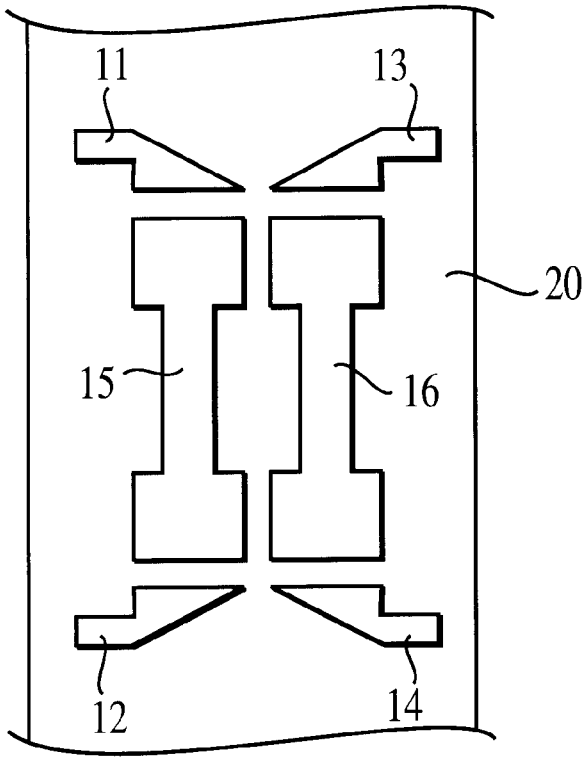
FIG. 1A is a plan view of a dielectric filter according to a first embodiment.
Figure 1B:
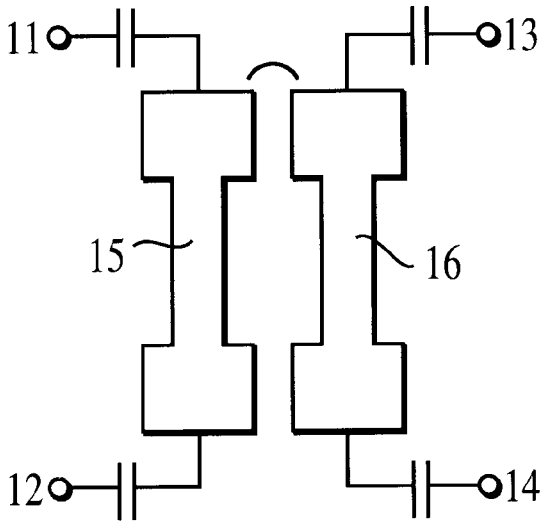
FIG. 1B is an equivalent circuit diagram of the dielectric filter according to the first embodiment.

Referring to FIGS. 1A and 1B, a description will be given of a configuration of a dielectric filter according to a first embodiment of the present invention.

FIG. 1A is a plan view of the dielectric filter. The individual reference symbols 15 and 16 denote strip line electrodes; 11, 12, 13, and 14 denote terminal electrodes. These electrodes are formed on an upper face of a dielectric substrate 20. A ground electrode is formed on substantially the entirety of a lower face of the dielectric substrate 20. The dielectric substrate 20, the strip line electrodes 15 and 16, and the ground electrode form individual microstrip-line resonators. Electrostatic capacitance is generated between each of the terminal electrodes 11 and 12 and the vicinity of corresponding ends of the strip line electrode 15. Similarly, electrostatic capacitance is generated in between each of the terminal electrodes 13 and 14 and the vicinity of corresponding ends of the strip line electrode 16.

The aforementioned microstrip-line resonators comprising the strip line electrodes 15 and 16 work as two-end-open-circuited $\lambda/2$ resonators. The centers of the strip line electrodes 15 and 16 are equivalent to short-circuit points. The widths of the strip line electrodes at the short-circuit points are reduced, and the widths thereof at the open-circuit ends are increased. Thereby, the two resonators with the strip line electrodes 15 and 16 are permitted to couple together by electrostatic capacitance. Also, by forming each of the strip line electrodes in a stepped shape, the line length required to obtain a predetermined resonant frequency is reduced, to obtain overall miniaturization.

FIG. 1B is an equivalent circuit diagram of the dielectric filter shown in FIG. 1A. In the state shown in the figure, the two resonators having the strip line electrodes 15 and 16 are coupled together by capacitance, and the terminal electrodes 11 to 14 and the two resonators are also coupled by capacitance to each other. The potentials of the two ends of each of the resonators have the relationship of a 180-degree phase difference. Therefore, the terminal electrodes 11 and 12 and the terminal electrodes 13 and 14 can individually serve as balanced input/output terminals. For example, the terminal electrodes 11 and 12 can be used as balanced input terminals, and the terminal electrodes 13 and 14 can be used as balanced output terminals. In this case, the dielectric filter can be used as a two-stage bandpass filter.

As described above, the external coupling between the resonators and the terminal electrodes is by electrostatic capacitance. Therefore, the external coupling can be easily adjusted by adjusting the distances and the areas between the resonators and the terminal electrodes. In addition, since an external terminal is formed in the vicinity of each end of each resonator, symmetry of the electrode patterns can be improved, and stabilized balancing characteristics can thereby be obtained.

In the example shown in FIGS. 1A and 1B, although the adjacent resonators are coupled by capacitance, they may also be coupled by using lumped-parameter elements such as capacitors and inductors. In addition, resonators made of strip lines may be formed by providing the individual electrode patterns shown in FIGS. 1A and 1B on two dielectric substrates.

Hereinbelow, referring to FIGS. 2A and 2B, a description will be given of a configuration of a dielectric filter according to a second embodiment.

Figure 2A:
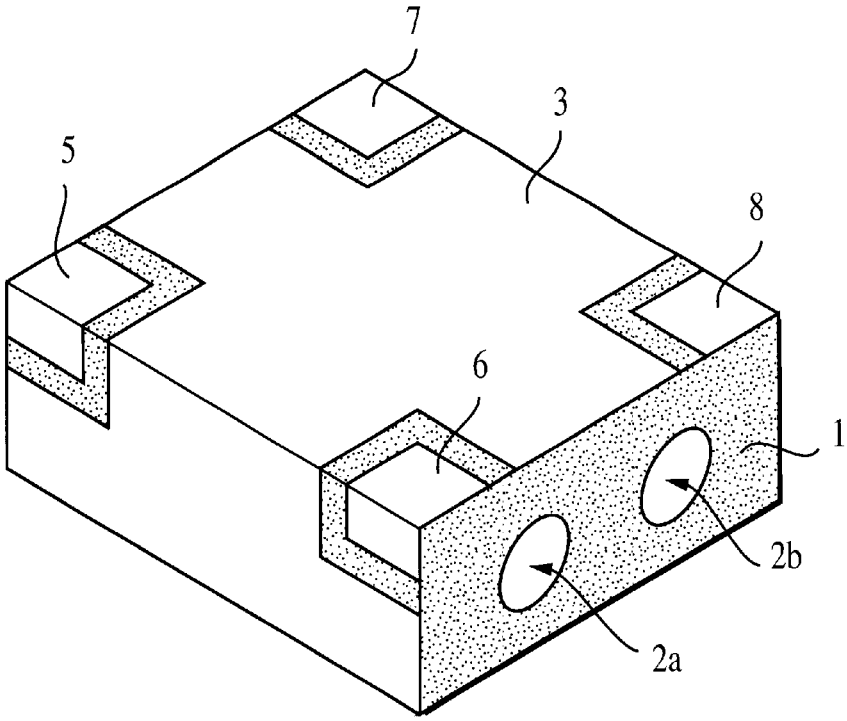
FIG. 2A is a perspective view of a dielectric filter according to a second embodiment.
Figure 2B:
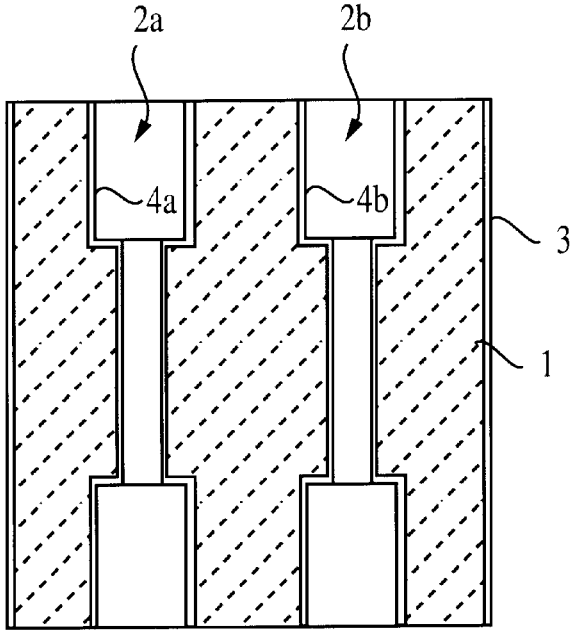
FIG. 2B is a cross-sectional view of the dielectric filter according to the second embodiment.

FIG. 2A is a perspective view of the dielectric filter, and FIG. 2B is a cross-sectional view taken in a plane extending through the central axes of inner-conductor-forming openings 2*a* and 2*b* that are shown in FIG. 2A. The upper face in the state shown in FIG. 2A is a mounting face for mounting on a substrate. In FIGS. 2A and 2B, 1 denotes a dielectric block that is substantially rectangular parallelepiped, and the two inner-conductor-forming openings 2*a* and 2*b* are provided therein. An outer conductor 3 is provided on four peripheral faces, excluding the faces at the end portions of the inner-conductor-forming openings 2*a* and 2*b* (four faces). Terminal electrodes 5, 6, 7, and 8 are individually formed to be isolated from the outer conductor 3. Inner conductors 4*a* and 4*b* are provided on inner faces of the inner-conductor-forming openings 2*a* and 2*b*.

In the described construction, the inner conductors 4*a* and 4*b* individually work as $\lambda/2$ resonators that resonate at a half wavelength and that have two ends being open-circuited. The terminal electrodes 5 and 6 are individually coupled by capacitance to the vicinities of open-circuit ends of the inner conductor 4*a* on the inner surface of the inner-conductor-forming opening 2*a*. Similarly, the terminal electrodes 7 and 8 are individually coupled by capacitance to the vicinities of open-circuit ends of the inner conductor 4*b* on the inner surface of the inner-conductor-forming opening 2*b*.

An equivalent circuit diagram of the dielectric filter shown in FIGS. 2A and 2B is similar to that shown in FIG. 1B. The dielectric filter described above is used as a balanced-input/output-type dielectric filter that has characteristics of a two-stage bandpass filter.

As described above, the external coupling between the resonators and the terminal electrodes is made by electrostatic capacitance. Therefore, the external coupling can be easily adjusted by adjusting distances and areas between the resonators and the terminal electrodes. In addition, two pairs of the terminal electrodes, each performing balanced input and/or output, are formed in positions symmetrical both in the direction between the two open-circuited end faces and in the direction between the input and the output of signals. This allows stabilized balancing characteristics to be obtained.

Hereinbelow, referring to FIGS. 3A to 3C, a description will be given of a configuration of a dielectric filter according to a third embodiment.

Figure 3A:
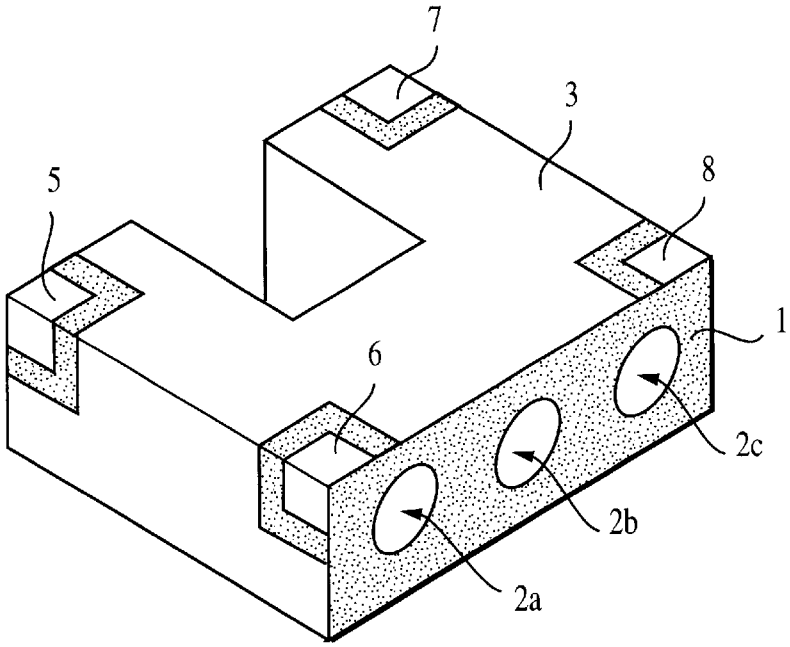
FIG. 3A is a perspective view of a dielectric filter according to a third embodiment.

FIG. 3A is a perspective view of the dielectric filter. FIG. 3B is a cross-sectional view taken in a plane extending through the central axes of inner-conductor-forming openings 2*a*, 2*b*, and 2*c* that are shown in FIG. 3A. FIG. 3C is a circuit diagram of the dielectric filter shown in FIGS. 3A and 3B. The upper face in the state shown in FIG. 3A is a mounting face for mounting on a substrate.

Figure 3B:
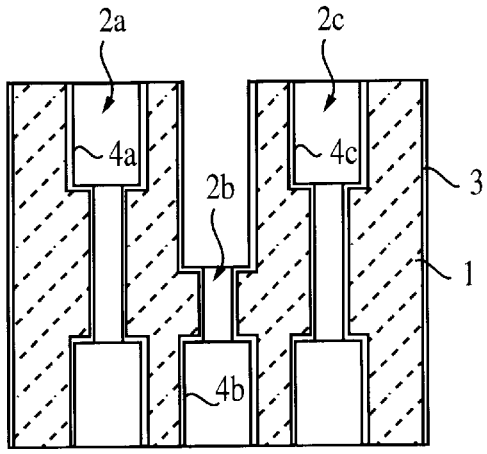
FIG. 3B is a cross-sectional view of the dielectric filter according to the third embodiment.

In FIGS. 3A and 3B, 1 denotes a dielectric block that is substantially a rectangular parallelepiped and the three inner-conductor-forming openings 2*a*, 2*b*, and 2*c* are provided therein. The inner-conductor-forming opening 2*b* is arranged to be substantially half the length of each of the inner-conductor-forming openings 2*a* and 2*c*, one end thereof is arranged to be an open-circuited end face, and the other end is arranged to be a short-circuit-end face. Opening end portions of the inner-conductor-forming openings 2*a* and 2*c* are arranged to be open-circuited end faces. An outer conductor 3 is formed on all the outer faces except these open-circuited end faces, and terminal electrodes 5, 6, 7, and 8 are formed so as to be isolated from the outer conductor 3. Inner conductors 4*a*, 4*b*, and 4*c* are formed on inner faces of the inner-conductor-forming openings 2*a*, 2*b* and 2*c*, respectively.

In the described construction, the inner conductors 4*a* and 4*c* individually work as λ/2 resonators that resonate at a half wavelength and have two ends open-circuited. In addition, the inner conductor 4*b* works as a λ/4 resonator that resonates at 1/4 wavelength and has one end open-circuited and the other end short-circuited. The adjacent resonators are coupled together by capacitance.

Figure 3C:
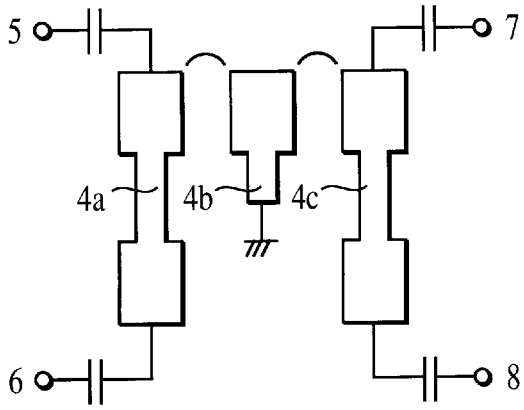
FIG. 3C is an equivalent circuit diagram of the dielectric filter according to the third embodiment.

As shown in FIG. 3C, the terminal electrodes 5 and 6 are individually coupled by capacitance to the vicinities of the open-circuit ends of the inner conductors 4*a* on the inner surface of the inner-conductor-forming opening 2*a*. Similarly, the terminal electrodes 7 and 8 are individually coupled by capacitance to the vicinities of the open-circuit ends of the inner conductor 4*c* on the inner surface of the inner-conductor-forming opening 2*c*. Thus, the above arrangement produces a dielectric filter that has characteristics of a bandpass filter. This dielectric filter uses the terminal electrodes 5 and 6 as balanced input terminals and the terminal electrodes 7 and 8 as balanced output terminals.

In the example shown in FIGS. 3A to 3C, the outer resonators are arranged to be λ/2 resonators, and the inner resonator is arranged to be a λ/4 resonator. However, the arrangement may be such that, conversely, outer resonators are λ/4 resonators, and an inner resonator is a λ/2 resonator. Also, the number of the resonators may be four or more.

In this way, the arrangement of at least one of the plurality of resonators to be the λ/4 resonator produces an advantage in that the frequency that generates spurious-mode components can be adjusted. Furthermore, it produces an advantage that the spurious-mode frequency can be adjusted to a level (value) that causes no influence on the characteristics of the dielectric filter.

Hereinbelow, referring to FIGS. 4A to 4C, a description will be given of a configuration of a dielectric duplexer according to a fourth embodiment.

Figure 4A:
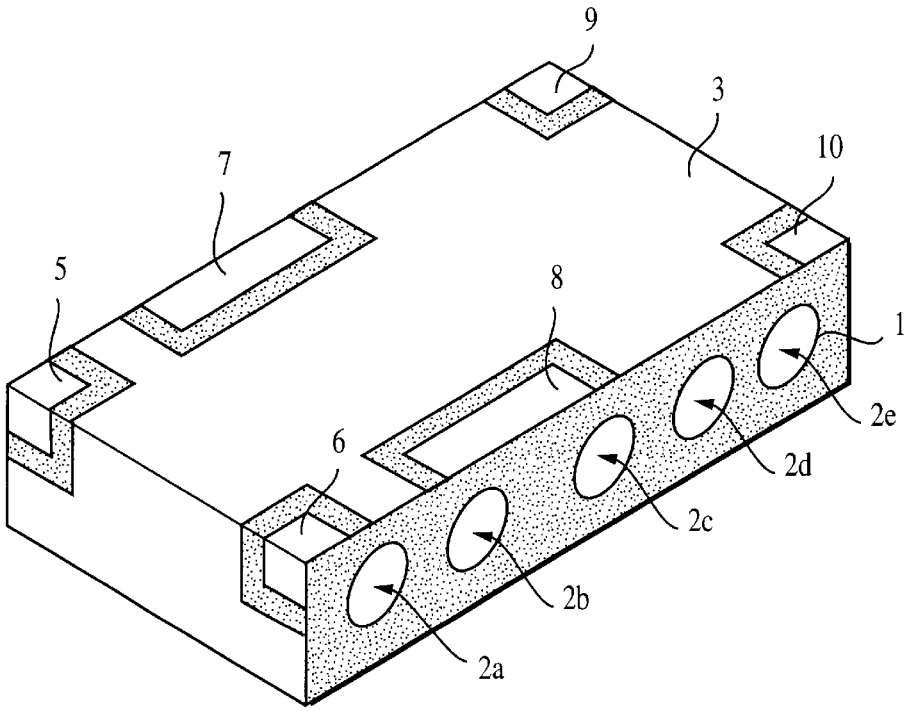
FIG. 4A is a perspective view of a dielectric duplexer according to a fourth embodiment.

FIG. 4A is a perspective view of the dielectric duplexer. FIG. 4B is a cross-sectional view taken in a plane extending through the central axes of individual inner-conductor-forming openings 2*a* to 2*e* in the dielectric duplexer. FIG. 4C is a circuit diagram of the dielectric duplexer. The upper face in the state shown in FIG. 4A is a mounting face for mounting on a substrate.

Figure 4B:
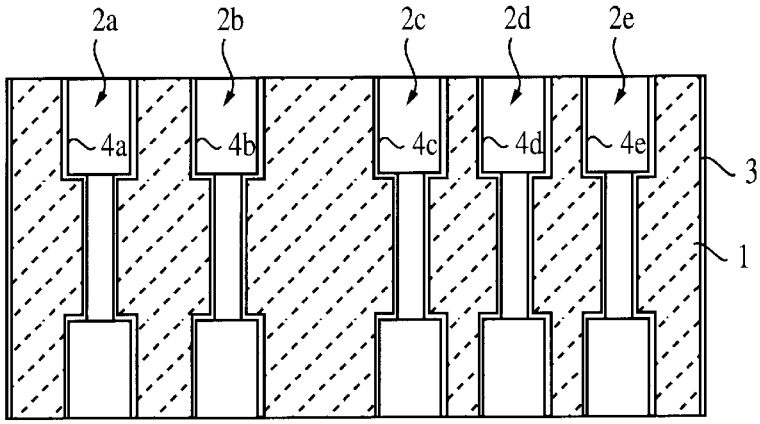
FIG. 4B is a cross-sectional view of the dielectric duplexer according to the fourth embodiment.

In FIGS. 4A and 4B, 1 denotes a dielectric block that is substantially a rectangular parallelepiped, and the five inner-conductor-forming openings 2*a* to 2*e* are provided therein. Two end faces of the inner-conductor-forming openings 2*a* to 2*e* are arranged to be open-circuited end faces. An outer conductor 3 is formed on the four outer faces excluding the open-circuited end faces. Terminal electrodes 5 to 10 are formed on the dielectric block and isolated from the outer conductor 3. Inner conductors 4*a* to 4*e* are formed on inner faces of the inner-conductor-forming openings 2*a* to 2*e*, respectively.

In the described dielectric duplexer, two dielectric filters having similar constructions to those shown in FIGS. 2A and 2B are provided in the single dielectric block 1, and terminal electrodes 7 and 8 are shared thereby. Specifically, a dielectric filter is configured with two resonators similar to those shown in FIGS. 2A and 2B corresponding to the inner-conductor-forming openings 2*a* and 2*b*, and another dielectric filter has three resonators corresponding to the inner-conductor-forming openings 2*c*, 2*d*, and 2*e*.

Figure 4C:
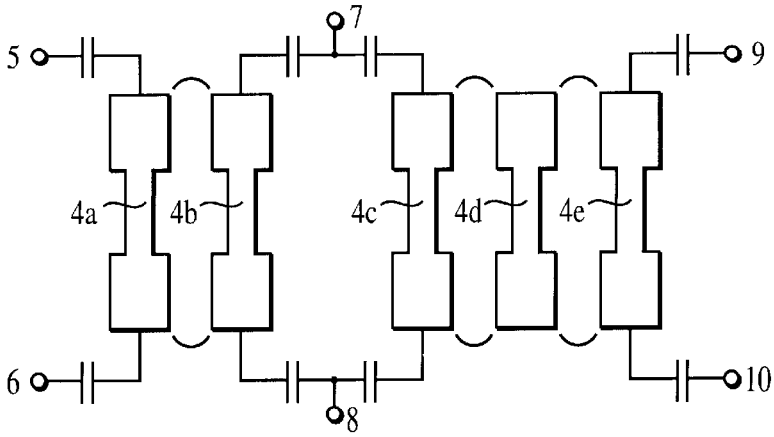
FIG. 4C is an equivalent circuit diagram of the dielectric duplexer according to the fourth embodiment.

Also, as shown in FIG. 4C, the terminal electrodes 5 and 6 are coupled by capacitance to the vicinity of open-circuited ends of an inner conductor 4*a* provided on an inner surface of the inner-conductor-forming opening 2*a*. The terminal electrodes 9 and 10 are coupled by capacitance to the vicinity of open-circuited ends of an inner conductor 4*e* provided on an inner surface of the inner-conductor-forming opening 2*e*. The terminal electrodes 7 and 8 are coupled by capacitance to the vicinity of both open-circuited ends of an inner conductor 4*b* provided on an inner surface of the inner-conductor-forming opening 2*b*, and open-circuited ends of an inner conductor 4*c* provided on an inner surface of the inner conductor 2*c*.

The described dielectric duplexer can be used as an antenna-sharing unit that uses the terminal electrodes 5 and 6 as a transmission-signal input port, the terminal electrodes 7 and 8 as an antenna port, and the terminal electrodes 9 and 10 as a reception-signal output port.

Hereinbelow, referring to FIG. 5, a description will be given of a configuration of a communication apparatus using one of the above described dielectric filters or the above dielectric duplexer.

Figure 5:
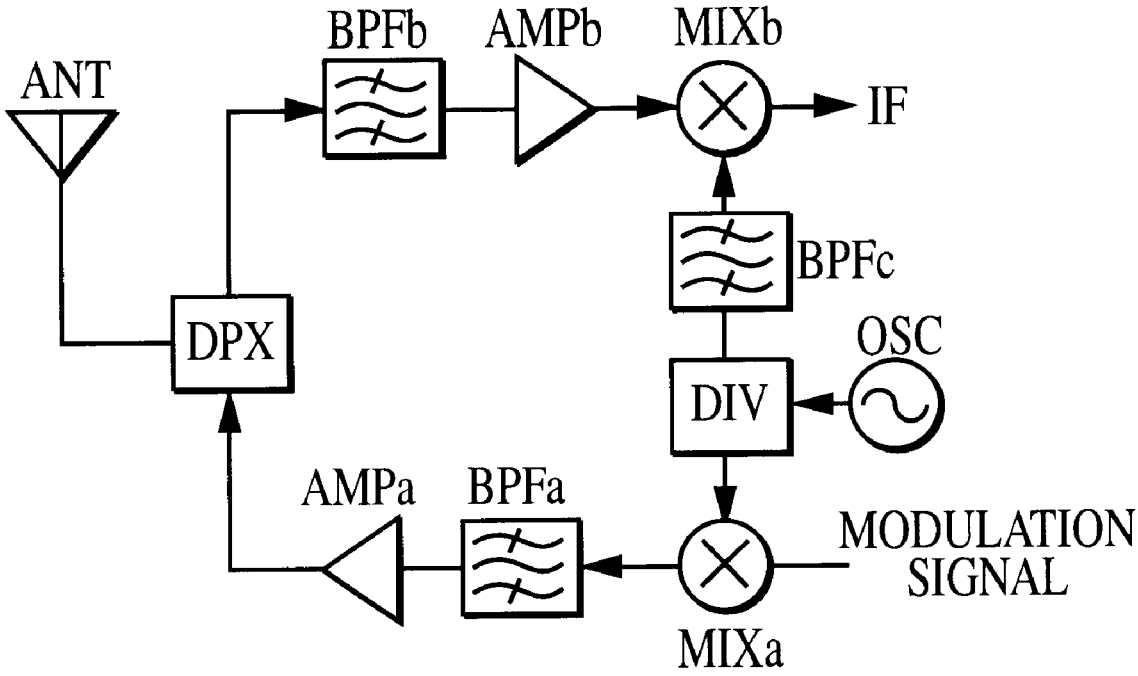
FIG. 5 is a block diagram showing a configuration of a communication apparatus according to a fifth embodiment.

In FIG. 5, ANT denotes a transmission/reception antenna; DPX denotes a duplexer; BPFa, BPFb, and BPFc each denote a bandpass filter; AMPa and AMPb each denote an amplifier circuit; MIXa and MIXb each denote a mixer; OSC denotes an oscillator; and DIV denotes a synthesizer.

The mixer MIXa uses modulation signals to modulate frequency signals outputted from the synthesizer DIV. The bandpass filter BPFa passes the signals only in a transmission-signal band. The amplifier circuit AMPa performs power-amplification of the signals, and transmits them via the antenna ANT via the duplexer DPX. The bypass filter BPFb passes only signals in a reception-signal band out of those outputted from the duplexer DPX, and the amplifier circuit AMPb amplifies them. The mixer MIXb mixes individual frequency signals outputted from the bandpass filter BPFc and reception signals and output mixed signals to intermediate frequency signals IF.

In a case where amplifier circuits AMPa and AMPb shown in FIG. 5 are balanced-input/output-type circuits, a duplexer having the construction as shown in FIG. 4 is used for the portion of the duplexer DPX. Also, for the bandpass filters BPFa and BPFb, dielectric filters of the constructions as shown in FIGS. 1 to 3 are used. In this way, with these balanced-type circuits, since signals can be filtered, and concurrently, can be inputted and/or outputted without a balun being used, a communication apparatus that is small in overall size can be constructed.

Although the present invention has been described in relation to particular embodiments thereof, many other variations and modifications and other uses will become apparent to those skilled in the art. Therefore, the present invention is not limited by the specific disclosure herein.

What is claimed is:

1. A balanced dielectric filter comprising conductor films formed on dielectric material, said filter comprising:

at least two coupled λ/2 resonators, each having two open-circuited ends, and having ½-wavelength resonance at a predetermined frequency; and a pair of terminals each being coupled respectively to the vicinity of a respective one of said open-circuited ends of a corresponding one of said λ/2 resonators and operable to perform balanced input and/or output of signals, wherein each terminal and the corresponding one of said open-circuited ends are disposed at a same face of said dielectric material; further wherein said terminals are coupled to said resonators by electrostatic capacitance.

2. A balanced dielectric filter comprising conductor films formed on dielectric material, said filter comprising:

at least two coupled λ/2 resonators, each having two open-circuited ends, and having ½-wavelength resonance at a predetermined frequency; and a pair of terminals each being coupled respectively to the vicinity of a respective one of said open-circuited ends of a corresponding one of said λ/2 resonators and operable to perform balanced input and/or output of signals, wherein each terminal and the corresponding one of said open-circuited ends are disposed at a same face of said dielectric material;

wherein each of said at least two λ/2 resonators is a dielectric coaxial resonator.

3. A dielectric filter as claimed in claim 1, further comprising an intermediate resonator coupled to both of said at least two coupled λ/2 resonators.

4. A balanced dielectric filter comprising conductor films formed on dielectric material, said filter comprising:

at least two coupled λ/2 resonators, each having two open-circuited ends, and having ½-wavelength resonance at a predetermined frequency; and a pair of terminals each being coupled respectively to the vicinity of a respective one of said open-circuited ends of a corresponding one of said λ/2 resonators and operable to perform balanced input and/or output of signals, wherein each of said at least two λ/2 resonators comprises a microstrip line or a strip line; further wherein said terminals are coupled to said resonators by electrostatic capacitance.

5. A balanced dielectric filter comprising conductor films formed on dielectric material, said filter comprising:

at least two coupled λ/2 resonators, each having two open-circuited ends, and having ½-wavelength resonance at a predetermined frequency; and a pair of terminals each being coupled respectively to the vicinity of a respective one of said open-circuited ends of a corresponding one of said λ/2 resonators and operable to perform balanced input and/or output of signals, and further comprising an intermediate λ/4 resonator coupled to both of said at least two coupled λ/2 resonators; further wherein said terminals are coupled to said resonators by electrostatic capacitance.

6. A dielectric duplexer comprising first and second balanced dielectric filters comprising conductor films formed on dielectric material, each said filter comprising:

at least first and second coupled λ/2 resonators, each resonator having two open-circuited ends, and having ½-wavelength resonance at a predetermined frecuency; and first and second pairs of terminals corresponding respectively to said first and second λ/2 resonators and operable to perform balanced input and/or output of signals, each said terminal being coupled to the vicinity of a respective end of the corresponding resonator;

said first pair of terminals of said first filter providing a transmission input of said duplexer, said first pair of terminals of said second filter providing a reception output of said duplexer, and said second pair of terminals of said first filter being connected respectively to said second pair of terminals of said second filter to form an antenna terminal of said duplexer.

7. A dielectric duplexer as claimed in claim 6, wherein said terminals are coupled to said resonators by electrostatic capacitance.

8. A dielectric duplexer as claimed in claim 6, wherein each of said at least two λ/2 resonators is a dielectric coaxial resonator.

9. A dielectric duplexer as claimed in claim 6, further comprising an intermediate resonator coupled to both of said at least two coupled λ/2 resonators.

10. A dielectric duplexer as claimed in claim 6, wherein in each said filter, each terminal and the corresponding one of said open-circuited ends are disposed at a same face of said dielectric material.

11. A dielectric duplexer comprising first and second balanced dielectric filters comprising conductor films formed on dielectric material, each said filter comprising:

at least first and second coupled λ/2 resonators, each resonator having two open-circuited ends, and having ½-wavelength resonance at a predetermined frequency; and first and second pairs of terminals corresponding respectively to said first and second λ/2 resonators and operable to perform balanced input and/or output of signals, each said terminal being coupled to the vicinity of a respective end of the corresponding resonator;

said first pair of terminals of said first filter providing a transmission input of said duplexer, said first pair of terminals of said second resonator providing a reception output of said duplexer, and said second pair of terminals of said first filter being connected respectively to said second pair of terminals of said second filter to form an antenna terminal of said duplexer, wherein each of said at least two λ/2 resonators comprises a microstrip line or a strip line.

12. A dielectric duplexer comprising first and second balanced dielectric filters comprising conductor films formed on dielectric material, each said filter comprising:

at least first and second coupled λ/2 resonators, each resonator having two open-circuited ends, and having ½-wavelength resonance at a predetermined frequency; and first and second pairs of terminals corresponding respectively to said first and second λ/2 resonators and operable to perform balanced input and/or output of signals, each said terminal being coupled to the vicinity of a respective end of the corresponding resonator;

said first pair of terminals of said first filter providing a transmission input of said duplexer, said first pair of terminals of said second resonator providing a reception output of said duplexer, and said second pair of terminals of said first filter being connected respectively to said second pair of terminals of said second filter to form an antenna terminal of said duplexer, and further comprising an intermediate λ/4 resonator coupled to both of said at least two coupled λ/2 resonators.

13. A communication apparatus comprising:

a balanced high-frequency circuit comprising one of a transmission circuit and a reception circuit; and connected to said balanced high-frequency circuit, a balanced dielectric filter comprising conductor films formed on dielectric material, said filter comprising:

at least two coupled λ/2 resonators, each having two open-circuited ends, and having ½-wavelength resonance at a predetermined frequency; and a pair of terminals each being coupled respectively to the vicinity of a respective one of said open-circuited ends of a corresponding one of said λ/2 resonators and operable to perform balanced input and/or output of signals.

14. A communication apparatus as claimed in claim 13, wherein each terminal and the corresponding one of said open-circuited ends are disposed at a same face of said dielectric material.

15. A communication apparatus comprising:

a transmission circuit;

a reception circuit; and a dielectric duplexer comprising first and second balanced dielectric filters comprising conductor films formed on dielectric material, each said filter comprising:

at least first and second coupled λ/2 resonators, each resonator having two open-circuited ends, and having ½-wavelength resonance at a predetermined frequency; and first and second pairs of terminals corresponding respectively to said first and second λ/2 resonators and operable to perform balanced input and/or output of signals, each said terminal being coupled to the vicinity of a respective end of the corresponding resonator;

said first pair of terminals of said first filter providing a transmission input of said duplexer, said first pair of terminals of said second filter providing a reception output of said duplexer, and said second pair of terminals of said first filter being connected respectively to said second pair of terminals of said second filter to form an antenna terminal of said duplexer;

said transmission circuit being connected to said transmission input of said duplexer, and said reception circuit being connected to said reception output of said duplexer.

16. A communication apparatus as claimed in claim 15, wherein in each said filter, each terminal and the corresponding one of said open-circuited ends are disposed at a same face of said dielectric material.

* * * * *